US006079262A

United States Patent [19]

Palomeque et al.

[11] Patent Number: 6,079,262

[45] Date of Patent: Jun. 27, 2000

[54] COIN IDENTIFICATION PROCEDURE

[75] Inventors: Francisco Ibanez Palomeque; Jose Luis Pina Insausti, both of Pamplona, Spain

[73] Assignee: Azkoyen Industrial, S.A., Spain

[21] Appl. No.: 08/723,236

[22] Filed: Sep. 27, 1996

[30] Foreign Application Priority Data

Sep. 28, 1995 [ES] Spain ..... 9501875

[51] Int. Cl.[7] ..... G07D 5/00; G07F 3/02

[52] U.S. Cl. ..... 73/163; 194/317

[58] Field of Search ..... 73/163; 194/303, 194/317, 327

[56] References Cited

U.S. PATENT DOCUMENTS

| | | | |
|---|---|---|---|
| 4,096,933 | 6/1978 | Massa | 194/100 A |
| 4,848,556 | 7/1989 | Shah et al. | 194/212 |
| 5,062,518 | 11/1991 | Chitty et al. | 194/317 |
| 5,191,956 | 3/1993 | Ibarrola | 194/317 |
| 5,226,520 | 7/1993 | Parker | 194/317 |
| 5,469,952 | 11/1995 | Kershaw et al. | 194/317 |

FOREIGN PATENT DOCUMENTS

| | | | |
|---|---|---|---|
| 364079 | 4/1990 | European Pat. Off. | 194/317 |
| 2017390 | 10/1971 | Germany . | |
| 2322539 | 11/1974 | Germany | 73/163 |
| 8308113 | 7/1982 | Spain . | |
| 2026784 | 5/1992 | Spain . | |
| 656240 | 6/1986 | Switzerland | 194/317 |
| 2168185 | 6/1986 | United Kingdom | 73/163 |
| 2224590 | 5/1990 | United Kingdom | 194/317 |
| 2240649 | 8/1991 | United Kingdom | 73/163 |
| 8300400 | 2/1983 | WIPO . | |

*Primary Examiner*—Hezron Williams
*Assistant Examiner*—Willie Morris Worth
*Attorney, Agent, or Firm*—Rothwell, Figg, Ernst & Kurz

[57] ABSTRACT

The energy of the sound radiation caused by the impact of the coin to be analyzed upon a hard surface is split into different frequency bands, the energy of every such band is obtained and the ratios between them are then worked out, obtaining parameters that are then compared against values representing valid coins. The device includes a bank of filters (6, 7 and 8), integrators (9, 10 and 11) connected to the outlet of the filters and capable of being activated from a microprocessor (17) and an analogue-digital converter to which the output of the various integrators is then connected through a multiplexer.

19 Claims, 1 Drawing Sheet

COIN IDENTIFICATION PROCEDURE

BACKGROUND OF THE INVENTION

This invention refers to a procedure to identify coins, based upon their mechanical features, and more specifically based upon the sound issued whenever the coin being analyzed hits a hard surface.

Many procedures for the identification and classification of metal pieces, such as coins and tokens, which use signals supplied by electronic sensors, particularly of the electromagnetic, optical and extensometric types, are currently known. The analysis of the coin is effected whilst it rolls and passes sequentially through the various sensors.

Also known are devices used to analyze vibrations issued when the coin hits a hard surface. The kinetic energy of the coin generates vibrations, both within the coin itself and upon the area subject to the impact. An analysis of those vibrations may yield an indirect measurement of the characteristics, characteristics related to the size and weight of the coin.

Thus, patent number ES 8,308,113 (Meyer) describes a piezoelectric sensor in which the impact of the coin results in an electrical output corresponding to its elasticity.

U.S. Pat. No. 4,848,556 (Qonnar) does also use a piezoelectric sensor that is subjected to the impact of a coin, from which a measurement of the mass of the coin may be obtained.

Patent number ES 9002855 (Mars) uses a piezoelectric sensor fitted near the coin impact area and which is sensible to the high frequencies generated by the impact upon the element against which the coin collides. These vibrations are then transferred to the piezoelectric sensor through the frame of the coin discriminator itself.

The patents mentioned above analyze the vibrations at the impact area, generated by the collision of the coin. There are also procedures to analyze the vibrations generated within the coin itself following the impact, based upon a study of the acoustic signal issued by the coin after the impact. Patents number DE 2017390 and U.S. Pat. No. 5,062,518 may be quoted as significant examples.

Patent number 2017390 describes a procedure used to analyze the sound issued by the coin which signal is being studied using a microphone located near the impact area, determining the acceptability of the coin as a function of the appearance or non appearance of a frequency characteristic for each denomination.

U.S. Pat. No. 5,062,518 (Plessey) describes a coin discriminating device that analyzes the sound of the coin shortly after its impact, obtaining the spectrum in a wide range of frequencies and determining the acceptability of the coins as a function of the appearance or non appearance of their expected frequencies, different for each type of coins.

Both the devices that analyze the vibrations induced by the coin upon the impact area and those that analyze the vibrations of the coin itself present drawbacks that have caused their use to be very significant. Specifically, the systems described by patents ES 8308113 and U.S. Pat. No. 4,848,556 require that the coins impact upon the sensor from a well defined height and without any dampening within their trajectory prior to the impact, conditions that are difficult to achieve in practice.

Patent number ES 9002855 describes a device of the type mentioned in the two prior patents, but which is less sensible to the height from which the coin drops down to the impact surface. This device is nevertheless valid only to discriminate elasticity counterfeit alloys, or else forgeries that incorporate a ring made of a soft material around them.

Patents number DE 2017390 and U.S. Pat. No. 5,062,518, which analyse the sound spectrum of the coin for its identification, have as a drawback that the coin, depending upon the angle of incidence, drop height or even the specific coin impact point, does not always produce the same sound signal. Even in the most favourable mechanical arrangement case, it would require a complex electronic device to precisely discriminate the various frequencies that characterize the different types of coins, often closely related to each other.

SUMMARY OF THE INVENTION

The object of this invention is a coin identification procedure, based upon the analysis of the sound produced by the coins, following its impact against a hard surface, that eliminates the previously mentioned drawbacks, supplying at the same new criteria applicable to the identification of coins. The device used to put into practice the previously mentioned procedure is also object of the invention.

Substantially, the procedure is based upon the analysis, in at least two frequency bands, of the sound radiation energy issued by the coin after impact. The ratio between the bands is worked out once the energy in each of them is obtained such as, for instance, the quotient between the energies of two different bands. The study of the energy of each band and the obtention of the ratios between them is effected immediately after the coin impact, and preferably during a period of time shorter than the duration of the sound signal produced by the coin. It would then be possible to successively repeat the study already described in order to obtain a measurement to indicate the decay of the energy in each band as a function of the amount of time elapsed since the impact.

Both the energy ratios of the various bands and the decay of those energies as a function of time supply information about the mechanical properties of the coin alloy, as well as about the possible manipulations used in the construction of counterfeit coins, such as supplementary rings placed around a lesser diameter coin and side supplements made of different metals, used to increase or decrease its electrical conductivity and simulate a higher value coin.

These energy ratios do also supply usable information about the constructional features of the coin (size and shape).

The fact of working out the relative values between the energies of the various frequency bands has the advantage that the results obtained are practically independent of the energy with which the coin arrives at the impact area. The consequence of this is a good repeatability of the measurements that represent the coin features to be measured.

In short, the results obtained using the procedure of the invention will not be affected by the coin drop height, angle of incidence between the coin and the impact surface, etc. thus achieving measurements that are far more reliable than those obtained using the previously mentioned already known procedures.

The device used to effected the procedure of the invention includes a hard surface upon which the coin to be analyzed impacts, a microphone that picks up the sound signal produce by the coin impact, a filter to eliminate the low sound frequencies, a wide band amplifier and a set of filters that covers the whole of the audible spectrum and near-by ultrasonic ons, and to which outlet are connected respective integrators that are powered from a microprocessor.

The device is completed with an analogue-digital converter and a multiplexer through which the outlets of the various integrators are connected to the analogue digital converter.

The previously mentioned microprocessor shall work out the ratios between the various energies using the data obtained and shall then compare it against the acceptable values stored in memory producing, as applicable, a signal to activate the coin admission gate, together with signals to identify the validated coins.

The above features and advantages may be better understood using the description set out below, made with reference to the attached drawings, that represent a non limitative example of execution.

DETAILED DESCRIPTION OF THE PREFERRED EMBODIMENTS

Figure 1:
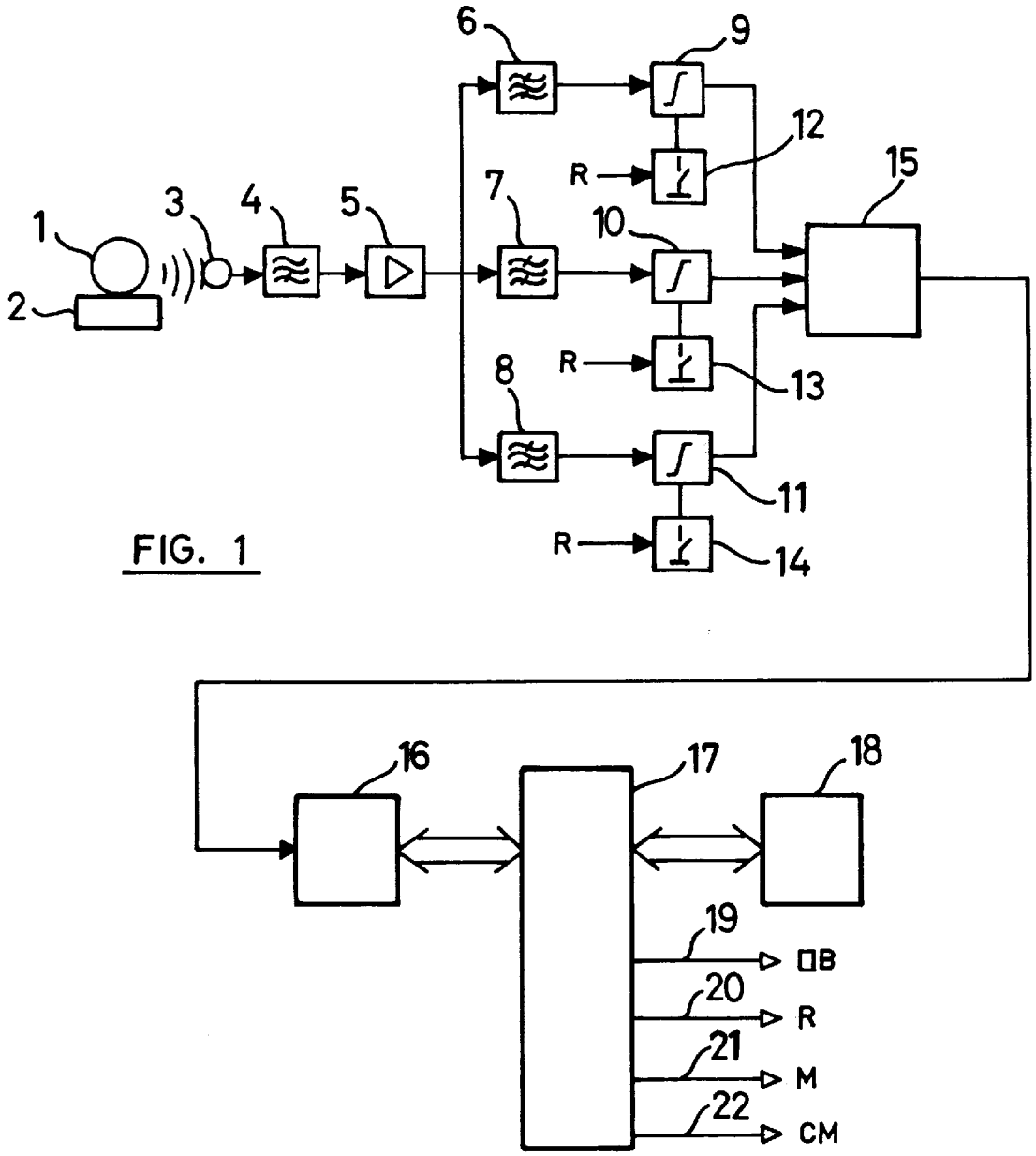
FIG. 1 is a block diagram of a preferred execution of the device object of the invention.

With reference to FIG. 1, whenever the coin (1) being examined hits, upon falling, the impact surface (2), it generates a sound signal which is picked by a microphone (3) that covers, besides the audible spectrum, also the nearby ultrasonic spectrum, located at the impact area and near the coin.

The electric signal supplied by that microphone is filtered using the filter unit (4) that takes out the low frequencies (below 0.5 kHz), that are typical of the small knocking and friction sound produced by the coin during its passage through the coin inlet and entry conduit towards the impact area and also produced as a consequence of the coin impact, but which are not representative of the coin, but instead of the sound waves produced by the frame of the device.

The electric signal at the filter outlet is then subjected to a wide band amplifier stage (5), so as to enable the signal to reach a sufficiently convenient level.

The amplifier output is then applied to a filter bank (6), (7) and (8), typically of the band stage type, although it may be advantageous, in some cases, to use a low stage for the first filter (6) and a high stage for the last one (8). The filters, three in this example, are designed so that their cut-off frequencies and their slopes be such that they may cover the maximum possible spectrum with the least possible overlap.

Figure 2:
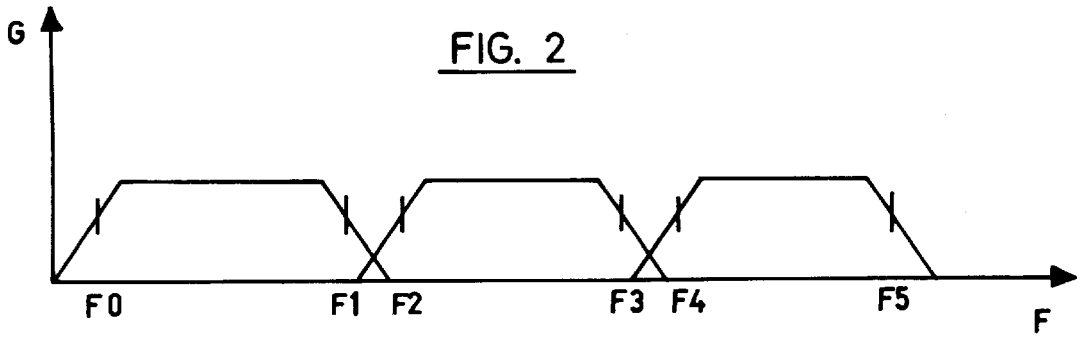
FIG. 2 represents the frequency response of a filter bank of a preferred execution.

A filter appropriate for this application may be a 5th order chebyshev. FIG. 2 represents the typical response of the proposed filter bank, $F_0$, $F_1$, $F_2$, $F_3$, $F_4$ and $F_5$ represent the cut-off frequencies of each one of the filters, as a guide, the cut-off frequencies may be as follows:

$F_0$=0.5 kHz $F_1$=6.5 kHz $F_2$=7 kHz $F_3$=14 kHz $F_4$=15 kHz $F_5$=40 kHz

Each one of the signals filtered by the previously described filter bank is introduced into its respective integrating stage (9), (10) and (11), controlled by switches (12), (13), and (14) to keep them inactive until the microprocessor (17) supplies the integration start signal through an activation signal outlet (20). The signal shall activate the integrating states whenever the coin impact is detected. This may be done by examining the amplifier outlet (5) or else that of the filters (6), (7) and (8).

Every time that the signal deactivates the integrators (9), (10) and (11) the outlet of said integrators return to zero, becoming therefore ready for a new integration. It is then possible to effect several consecutive samplings at the coin impact area, enabling the study of the time based energy dampening of the various frequency bands. The outlets of each one of the integrating stages are connected to a multiplexer (15), which outlet is connected to an analogue-digital converter (16) which is then connected to a microprocessor (17).

This structure makes it possible to measure the analogue outlet of each one of the integrating stages and to translate them to numerical values for their subsequent processing.

The microprocessor (17), using an appropriate operating program, shall detect the impact of the coin, enable the integrators using the signal from the activation signal outlet and, once the previously established period of time has lapsed, shall then measure the integrator output levels, sequentially connecting each of the outlets of the analogue to digital converter (16) using the multiplexer (15) and the control signal outlet (21).

As already explained, this measurement shall be carried out several times after the impact of the coin, in order to study the level of dampening, in terms of energy, in the various frequency bands.

Once the acquisition process is over, the microprocessor shall then run a program consisting of working out the ratios between the values read in each acquisition and between consecutive acquisitions, for the various frequency bands.

Thus, for the first acquisition, if the levels read are $L_1$, $M_1$ and $H_1$ respectively for the integrators (9), (10) and (11), the rations shall then be worked out as follows:

$$A_1 = \frac{H_1}{L_1};\ B_1 = \frac{H_1}{M_1};\ C_1 = \frac{M_1}{L_1}$$

Similarly, the following shall be obtained for the second acquisition:

$$A_2 = \frac{H_2}{L_2};\ B_2 = \frac{H_2}{M_2};\ C_2 = \frac{M_2}{L_2}$$

Additionally, the values representing the energy dampening in each band as a function of time are also worked out:

$$D_1 = \frac{L_2}{L_1};\ E_1 = \frac{M_2}{M_1};\ F_1 = \frac{H_2}{H_1}$$

New $A_1$, $B_1$, $C_1$, $D_{1-1}$, $E_{1-1}$ and $F_{1-1}$ ratios would be similarly worked out for acquisition number 1.

The results obtained by working out the relative values between the energies of the various frequency bands are practically independent of the height and angle of incidence of the coin upon the impact point.

The relative values so obtained are valid for use as the measurement parameters of a coin validation system evaluation process. To this end, the $A_1$, $B_1$, $C_1$, $D_{1-1}$, $E_{1-1}$ and $F_{1-1}$ calculated values shall be compared against the representative values of valid coins, which shall be stored in memory (18). Should the comparison happen to be positive, this shall then cause the activation of the gate (19) enabling the admission of the coin together with the issue of a signal from the coin identifying outlet (22) identifying the type of coin admitted.

The proposed measurement system may be complemented with other known methods, such as optical for the dimensional measurement of the coin or electromagnetic for electrical and magnetic characteristics of the alloy.

What is claimed is:

1. A coin identification device, comprising:

a surface of predetermined hardness upon which a coin to be identified can be dropped;

a sound transducer positioned adjacent said surface for converting a sound into an electric signal;

a plurality of filters connected to said sound transducer, with each filter of said plurality of filters passing an electronic signal corresponding to a distinct frequency band;

a plurality of integrators connected, respectively, to each of said filters, with said integrators obtaining energy levels of each distinct frequency band;

a memory capable of storing a plurality of predetermined energy levels in each distinct frequency band for one or more valid coins;

a processor connected to said integrators and said memory, and capable of comparing said energy levels obtained by said integrators to said plurality of predetermined energy levels, and further capable of generating an acceptance signal when a comparison is successful; and and a means for connecting said integrators to said processor.

2. The device according to claim 1, wherein said means for connecting said integrators to said processor comprises: a multiplexer connected to each of said integrators and capable of selecting an integrator as a multiplexer output from said multiplexer, and an analogue-digital converter connected to said multiplexer output of said multiplexer, and further connected to said processor, with said analogue-digital converter capable of converting said energy levels to digital energy levels.

3. The device according to claim 1, wherein each of said integrators can be enabled by said processor.

4. The device according to claim 1, wherein said sound transducer is a microphone.

5. The device according to claim 1, further comprising:

a pre-filter connected to said sound transducer and capable of eliminating frequencies from said electric signal that are below a predetermined threshold, and a pre-amplifier connected to said pre-filter and capable of amplifying said electric signal.

6. The device according to claim 5, wherein said predetermined threshold is five hundred cycles per second.

7. The device according to claim 1, wherein said acceptance signal of said processor is received by an admission gate for accepting or rejecting said coin.

8. The device according to claim 1, wherein said electric signal from said sound transducer is representative of an audible spectrum and a portion of an ultrasonic spectrum.

9. The device according to claim 8, wherein said portion of said ultrasonic spectrum extends from said audible spectrum up to about forty thousand cycles per second.

10. The device according to claim 1, wherein said plurality of filters includes three filters.

11. The device according to claim 1, wherein said plurality of integrators includes three integrators.

12. A coin identification process, comprising the steps of:

producing a sound signal by impacting a coin to be identified against a surface;

producing an electric signal corresponding to said sound signal;

splitting the electric signal corresponding to said sound signal into at least two frequency bands;

obtaining an energy level in each of said at least two bands;

obtaining a relative value between at least two of said energy levels; and comparing said obtained relative value against previously stored representative values obtained from valid coins.

13. The process according to claim 12, wherein said steps of splitting the electric signal and of obtaining the energy level in each band are repeated in at least one subsequent acquisition within a period of time equal or less than that of said sound signal produced by the coin upon impact; and further including obtaining additional relative values a) between the energy levels of the different bands of each said subsequent acquisition and b) between the energy levels of the bands of different acquisitions, and then comparing said additional relative values against previously obtained and stored characteristic values of valid coins.

14. The process according to claim 12, further including capturing the sound produced by the impact of the coin using a microphone to obtain said electrical signal in said step of producing an electric signal, amplifying said electric signal after filtering out the lowest frequencies of the spectrum, dividing said amplified electric signal into different frequency bands in said step of splitting, and integrating said divided amplified electric signal in order to obtain said energy levels in each frequency band in said step of obtaining energy levels.

15. The process according to claim 14, further including integrating the frequency bands at least one additional time, using previously established time intervals within the time taken by the sound signal produced by the impact of the coin, and obtaining relative values between the energy levels of the bands of each additional integration and between the energy levels of the bands corresponding to the same frequencies in different ones said integrations.

16. The process according to claim 14, wherein the division of the electrical signal amplified in different frequency bands is carried out using a filter bank.

17. The process according to claim 12, wherein the step of producing an electric signal further comprises: filtering out frequencies from said electric signal that are below a predetermined threshold, and amplifying said electric signal after said filtering step.

18. The process according to claim 17, wherein said filtering step comprises passing said electric signal through a filter.

19. The process according to claim 17, wherein the step of filtering out frequencies below a predetermined threshold further comprises filtering out frequencies below about five hundred cycles per second.

* * * * *